United States Patent [19]

Textoris et al.

[11] Patent Number: 5,017,344

[45] Date of Patent: May 21, 1991

[54] PROCESS FOR THE SEPARATION OF IRON FROM AN ORGANIC SOLUTION CONTAINING URANIUM

[75] Inventors: André Textoris, Bessines; Georges Lyaudet, Limoges; André Bathelier, Sceaux, all of France

[73] Assignee: Compagnie Generale des Matieres Nucleaires (Cogema), Velizy Villacoublay Cedex, France

[21] Appl. No.: 379,701

[22] Filed: Jul. 11, 1989

Related U.S. Application Data

[63] Continuation of Ser. No. 30,518, Mar. 27, 1987, abandoned.

[30] Foreign Application Priority Data

Mar. 28, 1986 [FR] France ..... 86 4558

[51] Int. Cl.[5] ..... C01G 43/00

[52] U.S. Cl. ..... 423/10; 423/139

[58] Field of Search ..... 423/8, 10, 139

[56] References Cited

U.S. PATENT DOCUMENTS

| | | | |
|---|---|---|---|
| 3,288,568 | 11/1966 | Tomijima et al. | 423/10 |
| 4,105,741 | 8/1978 | Wiewierowski et al. | 423/10 |
| 4,108,957 | 8/1978 | Michel | 423/3 |
| 4,162,230 | 7/1979 | Horwitz et al. | 423/10 |
| 4,255,392 | 3/1981 | Chiang | 423/10 |
| 4,258,013 | 3/1981 | Pyrih et al. | 423/10 |
| 4,430,309 | 2/1984 | York | 423/10 |
| 4,432,946 | 2/1984 | Ginisty et al. | 423/10 |
| 4,435,367 | 3/1984 | Steck | 423/10 |
| 4,490,336 | 12/1984 | Worthington et al. | 423/10 |

FOREIGN PATENT DOCUMENTS

| | | |
|---|---|---|
| 0053054 | 6/1982 | European Pat. Off. . |
| 0065844 | 12/1982 | European Pat. Off. . |

*Primary Examiner*—Edward A. Miller

*Attorney, Agent, or Firm*—Larson & Taylor

[57] ABSTRACT

A process for separating iron +3 from uranium +6 is an organic solution of a neutral phosphine oxide and an acid organophosphorus compound. The uranium-containing organic solution is contacted with aqueous oxalic acid or an aqueous mixture of phosphoric acid and sulfuric acid so that most of the uranium remains in the organic solution and most of the iron passes into the aqueous acid.

20 Claims, 5 Drawing Sheets

PROCESS FOR THE SEPARATION OF IRON FROM AN ORGANIC SOLUTION CONTAINING URANIUM

This application is a continuation, of application Ser. No. 07/303,518 filed Mar. 27, 1987, now abandoned.

BACKGROUND OF THE INVENTION

The subject of the invention is a process for the separation of iron from an organic solution containing uranium.

More generally, the invention relates to a process for the extraction of uranium present in phosphoric acid solutions, especially in phosphoric acid solutions obtained from phosphate ores containing iron.

It is known that phosphate ores generally contain quantities of uranium which may be recovered during the treatment of phosphate ores with sulfuric acid.

This recovery is worthwhile, considering the large tonnage of phosphate ores treated with sulfuric acid.

During the treatment of ores with sulfuric acid, uranium passes into solution in the phosphoric acid obtained and processes for recovering uranium from the phosphoric acid employ suitable organic solvents such as those described in French Patent No. 2,369,803, which consist of a synergetic mixture of extractants.

The process developed using these solvents enables uranium to be extracted and purified in a single cycle, and iron is removed from the decanters in the form of a precipitate, when uranium is reextracted using ammonium carbonate.

New solvents, described in French Patent No. 2,442,796, certificate of addition No. 2,459,205 and French Patent No. 2,494,258, have also been developed.

These new solvents consist of stronger synergetic pairs. These new solvents extract larger amounts of uranium, but they also extract more iron, which makes the alkaline reextraction of uranium difficult, because of the undesirable presence of iron hydroxides which precipitate in an alkaline medium.

The use of organic solvents such as trioctylphosphine oxide and di-2-ethylhexyl phosphoric acid with dilute and substantially iron-free phosphoric acid has also been envisaged, but this process has the disadvantage either of bringing about a significant coextraction of uranium with the iron and therefore a loss of uranium which passes into the aqueous phase, or of having to operate in a dilute phosphoric acid medium which subsequently makes it necessary to reconcentrate the phosphoric acid or results in a loss of the latter (cf. French Patent No. 2,459,837).

The subject of the invention is a process for the extraction of uranium from an organic solution containing it and contaminated with iron.

One of the aspects of the invention is to provide a process for the separation of iron contamination an organic solution containing uranium, which process also enables uranium to be extracted at a high rate.

One of the other aspects of the invention is to provide a process which enables solvents capable of extracting uranium with a high yield to be used with ease, while eliminating the problems caused by the presence of iron.

One of the other aspects of the invention is to provide a process for the extraction of uranium which only comprises a single extraction-reextraction cycle, which avoids a second purification cycle and the dual operation of reduction-oxidation to reextract uranium, while overcoming the difficulties of carrying out the operation of direct alkaline reextraction of uranium.

One of the aspects of the invention is to provide a process for the separation of iron contaminating an organic solution containing uranium, which process does not require the valency of the uranium or that of the iron to be changed at any time.

One of the aspects of the invention is to provide a process for removing iron from or de-ironing phosphoric acid, which can be applied industrially and which can advantageously be integrated into a plant for the manufacture of phosphoric acid from rock phosphates, in which it is also desired to recover the uranium contained in the acid phosphates.

SUMMARY OF THE INVENTION

The process according to the invention for separating iron from an initial organic solution containing uranium, which contains at least 1 g/l of iron, which initial organic solution contains an organic solvent comprising an extractant system consisting of:

a neutral phosphine oxide of formula:

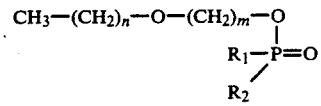

or of formula $(R_1)-P=0$ in which $R_1$ and $R_2$, which may be identical or different, represent a straight-chain or branched alkyl radical containing from 4 to 10, preferably 6 or 8, carbon atoms, m is an integer ranging from 1 to 3 and preferably taking the value 1, n is an integer ranging from 4 to 10 and preferably taking the value 7, and an acid organophosphorus compound corresponding to the formula:

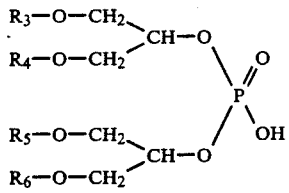

in which $R_3$, $R_4$, $R_5$ and $R_6$, which may be identical or different, represent a straight-chain or branched alkyl radical containing at least 4 carbon atoms, preferably from 4 to 10 carbon atoms, advantageously from 4 to 6 carbon atoms, or an aryl radical containing from 6 to 10 carbon atoms, which process comprises the reaction of the abovementioned uranium-containing organic solution with an acid chosen from amongst oxalic acid, a mixture of phosphoric acid and sulfuric acid or a mixture of deironed phosphoric acid and sulfuric acid, the uranium remaining in the initial organic solution and the iron passing into aqueous solution.

DETAILED DESCRIPTION OF THE INVENTION

Figure 1:
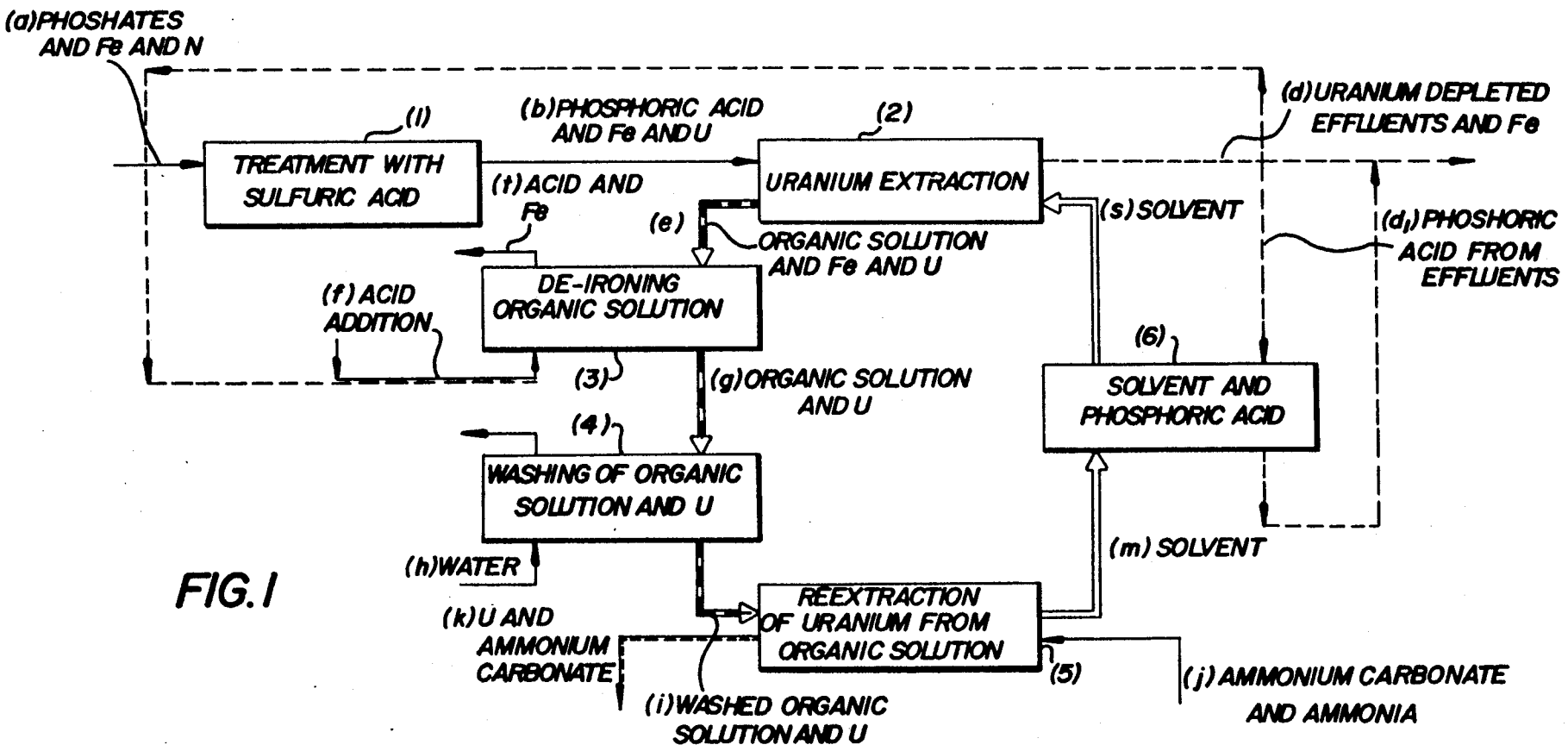
FIG. 1 is a block diagram of the overall process of the invention for obtaining uranium.

It was observed, quite surprisingly, that by using an acid chosen from amongst those mentioned above, in an initial organic solution containing uranium and iron, there was an adequate separation between the uranium and the iron so that the major part or all of the uranium remains in the organic phase and the major part or all of the iron is extracted from the initial organic solution and passes into the aqueous phase, which enables the uranium to be reextracted from the organic phase, without the uranium reextraction process being hindered by the presence of iron, which may, for example, precipitate, and without there being any loss of uranium due to its passing into the aqueous phase.

The quantity of uranium which remains in the organic phase corresponds to at least approximately 85%, and is approximately 85% to approximately 95% of the total quantity of uranium contained in the said initial organic solution, but, in general, the quantity of uranium which passes into the aqueous phase does not exceed approximately 10%.

The quantity of iron which passes into aqueous solution corresponds to approximately at least 60–70% of the total quantity of iron contained in the initial organic solution.

In the initial organic solution, the iron has a valency of 3 and is advantageously in the form of $Fe(PO_4\text{-}R_2)_3$, R representing the acid organophosphorus compound radical defined above, and the uranium has a valency of 6, and is advantageously in the form of $UO_2(PO_4R_2)_2$, R representing the acid organophosphorus compound radical defined above.

The process according to the invention can be advantageously applied to initial organic solutions in which the ratio between iron and uranium, Fe/U, is equal to or greater than approximately 0.8, especially greater than approximately 1, without an upper limit.

The process according to the invention can be advantageously applied to initial organic solutions in which the value of the ratio Fe/U varies from approximately 0.8 to approximately 2.5, and especially from approximately 1 to approximately 2.5.

The process of the invention can also be applied for values of the ratio Fe/U less than approximately 0.8.

The process of the invention can advantageously be applied to initial organic solutions which contain at least approximately 1200 mg/l of iron and at least approximately 1200 mg/l of uranium, as it enables the problems due to the subsequent precipitation of iron to be eliminated.

The values mentioned above are not critical because the process of the invention can also be applied to initial organic solutions which contain less than approximately 1200 mg/l of uranium and which may contain, for example, approximately 400 mg/l of uranium.

According to a preferred embodiment of the process of the invention, the initial organic solutions contain from approximately 0.3 to approximately 3 g/l of uranium, especially from approximately 0.4 to approximately 1.5 g/l of uranium and approximately 1 to approximately 4 g/l of iron, especially approximately 1.2 g/l of iron.

According to a preferred embodiment of the process of the invention, the initial organic solution consists of a mixture of two extractants chosen from amongst trioctylphosphine oxide (TOPO), di-n-hexyloctylmethoxyphosphine oxide (DinHMOPO), bis-1,3-dibutoxy-2-propylphosphoric acid (BIDIBOPP) and bis-1,3-dihexyloxy-2-propylphosphoric acid (BIDIBOTT) and especially the following pairs:

(TOPO-BIDIBOPP),
(TOPO-BIDIHOPP),
(DinHMOPO-BIDIBOPP) and
(DinHMOPO-BIDIHOPP).

According to an advantageous embodiment of the process of the invention, the initial organic solution containing iron and uranium originates from a starting phosphoric acid solution which contains uranium, especially at a rate from approximately 50 to approximately 300 mg/l, and iron, especially at a rate from approximately 1 to approximately 15 g/l, especially from approximately 1 to approximately 10 g/l.

In the starting phosphoric acid solution, the ratio U/Fe is generally from approximately 1:100 to 1:15, and changes to approximately 1:1 by the addition of an extractant system mentioned above, to form the initial organic solution, the uranium passes into the initial organic solution, the major part of the iron passes with the phosphoric acid and a part of the iron remains in the initial organic solution and must be removed therefrom.

With regard to the acid used for extracting iron from the initial organic solution, when oxalic acid is used, the latter, with organic compounds of uranium and iron, leads to the following reactions:

$$UO_2(PO_4R_2)_2+H_2C_2O_4\rightarrow UO_2(PO_4R_2)_2+H_2C_2O_4, \quad (1)$$

R representing the acid organophosphorous compound radical defined above,
in other words, there is no movement of uranium and the latter remains in the initial organic solution, $$2Fe(PO_4R_2)_3+3H_2C_2O_4\rightarrow Fe_2(C_2O_4)_3+6HPO_4R_2 \quad (2)$$

R representing the acid organophosphorous compound radical defined above, and
the iron oxalate passes into aqueous solution.

In implementing the process of the invention, oxalic acid is advantageously used at a rate of approximately 8 to approximately 10 kg per kg of iron to be extracted.

It is also possible to use quantities of oxalic acid (expressed in kg) less than approximately 8 kg per kg of iron to be extracted.

Oxalic acid is generally used at a concentration of approximately 5 to approximately 50 g/l, especially from approximately 5 to approximately 30 g/l and preferably approximately 20 g/l.

The oxalic acid may be regenerated, for example, by using calcium hydroxide $Ca(OH)_2$, at a rate of approximately 1 to approximately 4 kg, and sulfuric acid, at a rate of approximately 2 to approximately 8 kg, per kg of oxalic acid.

Oxalic acid is particularly advantageous insofar as it enables the iron and uranium to be separated effectively, so that all of the uranium remains in the initial organic solution.

According to another advantageous embodiment of the process of the invention, it is also possible to use a mixture of phosphoric acid and sulfuric acid, hereinafter called a sulfuric-phosphoric mixture.

In fact, it was observed that by changing the ratio between phosphoric acid and sulfuric acid, a different behaviour of iron and uranium is obtained.

According to an advantageous embodiment of the invention, the phosphoric acid used in the sulfuric-phosphoric mixture is uranium-depleted. "Uranium-depleted" phosphoric acid denotes phosphoric acid containing less than approximately 10 mg/l of uranium.

It is observed that the mixture of sulfuric acid and phosphoric acid which is advantageously uranium-depleted may be used without the need for carrying out a stage or reconcentration of the sulfuric-phosphoric acid, and without causing a too significant co-extraction of uranium.

A mixture of phosphoric acid and sulfuric acid with a total normality of 12 N to 20 N is advantageously used.

The normality of the sulfuric acid may vary from 3 N to 12 N, and the normality of the phosphoric acid may vary from 3 N to 12 N.

A mixture of sulfuric acid of normality 3 N and phosphoric acid of normality of 9 N is advantageously used, when the concentration of iron contained in the phosphoric acid is equal to or less than approximately 1.5 g/l.

When the concentration of iron in the phosphoric acid is greater than approximately 1.5 g/l, the concentration of sulfuric acid may be increased, the latter, in this case, advantageously being greater than or equal to 9 N.

The $H_2SO_4/H_3PO_4$ normality ratio may then advantageously vary from 3:1 to 1:3.

When the iron concentration in the phosphoric acid is greater than approximately 1.5 g/l, it is also possible to carry out a prior de-ironing of the phosphoric acid, which is advantageously uranium-depleted, i.e. containing less than approximately 10 mg/l of uranium, before the sulfuric-phosphoric mixture is prepared.

When the iron concentration in the phosphoric acid is greater than approximately 1.5 g/l, it is possible to increase the concentration of sulfuric acid and to carry out, at the same time, a de-ironing of the phosphoric acid, which is advantageously uranium-depleted.

According to another embodiment of the process of the invention, sulfuric-phosphoric mixture in which the phosphoric acid has previously been de-ironed, and has, advantageously, been previously de-ironed and uranium-depleted, may therefore be used.

In implementing the process of the invention, it is possible to obtain uranium-depleted and de-ironed phosphoric acid intended for the preparation of the sulfuric-phosphoric mixture by taking uranium-depleted phosphoric acid, obtained from uranium-containing phosphoric acid which contains iron, after extracting the uranium with one of the solvents defined above.

The advantage of using uranium-depleted and de-ironed phosphoric acid is that this phosphoric acid ay be used in the process of the invention, especially when the initial organic solution originates from a uranium-containing phosphoric acid solution which itself originates from phosphate ores.

the quantity of phosphoric acid taken corresponds at the most to approximately 10% of the quantity of phosphoric acid obtained from the uranium-depleted phosphoric acid which contains iron.

This uranium-depleted phosphoric acid is then reacted with one of the fresh or regenerated solvents defined above.

The iron contained in the uranium-depleted phosphoric acid is extracted from the uranium-depleted phosphoric acid and passes into the fresh or regenerated solvent and uranium-depleted and de-ironed phosphoric acid is obtained.

In practice, the preparation of de-ironed phosphoric acid is carried out by the counter-current extraction, for example, in five stages, with a fresh or regenerated organic solvent chosen from amongst those mentioned above, of uranium-depleted phosphoric acid.

Fresh or regenerated solvent is defined as solvent which is practically free of uranium and of iron, i.e. containing less than approximately 100 mg/l of iron, especially less than approximately 10 mg/l of iron, and less than approximately 10 mg/l of uranium and containing especially approximately 2 to 3 mg/l of uranium.

A solvent is considered to be regenerated when it has undergone an alkaline reextraction, especially with ammonium carbonate and ammonia, before being reused either in the extraction of uranium or in the de-ironing of phosphoric acid.

The de-ironed and advantageously uranium-depleted phosphoric acid used in the preparation of the sulfuric-phosphoric mixture used in the process of the invention generally has a concentration of approximately 1 M to 3 M.

It has been observed that the efficiently of de-ironing of the advantageously uranium-depleted phosphoric acid increases with decreasing concentration of the advantageously uranium-depleted phosphoric acid to be de-ironed.

Thus, it has been observed that the use of a uranium-depleted phosphoric acid to be de-ironed, of a concentration of approximately 3 M, leads to the production of a uranium-depleted and de-ironed phosphoric acid, using a fresh or regenerated solvent generally in one or two stages, whereas a uranium-depleted phosphoric acid to be de-ironed of a higher concentration, for example of approximately 4.5 M, requires 3 to 5 stages for the de-ironing.

The details given for the de-ironing of phosphoric acid which is especially uranium-depleted, containing a quantity of iron greater than 1.5 g/l, apply to phosphoric acid containing from 0 to 1.5 g/l of iron.

After de-ironing, the de-ironed phosphoric acid which forms part of the composition of the sulfuric-phosphoric mixture used in the process of the invention contain from approximately 50 mg/l to approximately 600 mg/ of iron.

The de-ironed phosphoric acid which forms part of the composition of the sulfuric-phosphoric mixture is advantageously of a concentration approximately 3 N to approximately 5 N.

A mixture of sulfuric acid of normality 9 N and de-ironed phosphoric acid of normality 3 N, or a mixture of sulfuric acid of a normality of approximately 12 N and phosphoric acid of normality 4 N, is advantageously used.

The choice of the value of the normality for the sulfuric acid and that for the phosphoric acid, which is de-ironed or otherwise, depends on the nature of the phosphoric acid employed, and especially on its iron content.

A mixture of sulfuric acid and phosphoric acid in which a part of the phosphoric acid is de-ironed may also be used. By way of a non-limiting example, it is possible to use sulfuric acid of normality 12 N, phosphoric acid of normality 2 N, containing more than approximately 1.5 g/l of iron, and de-ironed phosphoric acid (containing less than approximately 0.6 g/l of iron) of normality 2 N.

According to a preferred embodiment of the process of the invention, the concentration of sulfuric-phosphoric acid is approximately 450 g/l, considering the fact that the sulfuric acid has two acid groups and that the phosphoric acid has three acid groups.

The advantage of the sulfuric-phosphoric mixture of the chosen normality concentration is that is makes it possible:

to avoid the necessity of carrying out a reconcentration of the sulfuric-phosphoric mixture, which can be directly reused in the treatment of phosphates, and to limit the co-extraction of uranium.

According to a preferred embodiment of the invention, the process of the invention comprises the following stages:

a solvent chosen from amongst the following extractant systems:

(TOPO-BIDIBOPP),
(TOPO-BIDIHOPP),
(DinHMOPO-BIDIBOPP), and
(DinHMOPO-BIDIHOPP), is reacted with a starting phosphoric acid solution which contains uranium and iron and which has a gravimetric ratio U/Fe of approximately 1:10 to approximately 3:1000 to obtain on the one hand an initial organic solution which consists of the abovementioned solvent, containing at least approximately 95% of the quantity of uranium contained in the starting phosphoric acid and at least 1 g/l or iron, in which the gravimetric ratio Fe/U is greater than or equal to approximately 0.8:1, especially approximately 1:1 to approximately 2.5:1, and on the other hand a uranium-depleted aqueous phase containing the phosphoric acid and approximately 80% to approximately 90% of the iron contained in the starting phosphoric acid solution;

an acid chosen from amongst oxalic acid, a mixture of phosphoric acid and sulfuric acid, or a mixture of de-ironed phosphoric acid and sulfuric acid is reacted with the initial organic solution mentioned above to obtain on the one hand an aqueous phase containing approximately 50% to approximately 90%, especially approximately 70%, of the iron contained in the initial organic solution and on the other hand an organic phase containing at least 85% by weight of the uranium contained in the initial organic solution.

According to another preferred embodiment of the invention, the process of separating iron from a starting phosphoric acid solution which contains uranium and iron is defined in that it comprises the following stages:

a solvent chosen from among the following extractant systems:

(TOPO-BIDIBOPP),
(TOPO-BIDIHOPP),
(DinHMOPO-BIDIBOPP), and
(DinHMOPO-BIDIHOPP), is reacted with the starting phosphoric acid solution which contains uranium and iron, and which has a gravimetric ratio U/Fe of approximately 1:10 to approximately 3:1000 to obtain on the one hand the initial organic solution containing the abovementioned solvent which contains at least approximately 95% of the quantity of uranium contained in the starting phosphoric acid, and at least 1 g/l of iron, in which the gravimetric ratio Fe/U is greater than or equal to approximately 0.8:1, especially approximately 1:1 to approximately 2.5:1, and on the other hand a uranium-depleted aqueous phase which contains the phosphoric acid and approximately 80% to approximately 90% of the iron contained in the starting phosphoric acid solution and an acid chosen from amongst oxalic acid, a mixture of phosphoric acid and sulfuric acid or a mixture of de-ironed phosphoric acid and sulfuric acid is reacted with the abovementioned initial organic solution to obtain on the one hand an aqueous phase containing approximately 50% to approximately 90%, especially approximately 70%, of the iron contained in the initial organic solution and on the other hand an organic phase containing at least 85% by weight of the uranium contained in the initial organic solution.

In practice the de-ironing of the initial organic solution is generally carried out by the counter-current circulation, relative to the circulation of the initial organic solution, of one of the acids mentioned above.

The number of stages used is approximately 1 to 6, and preferably 2 to 4.

The period of contact between the initial organic solution and the acid is generally approximately 3 to 10 minutes.

The abovementioned organic phase which is obtained from the de-ironing of the initial organic solution and which contains the major part of the uranium is then advantageously washed, especially with water, until a $PO_4$ concentration in the organic solution of less than or equal to approximately 1 g/l is obtained.

The uranium is then reextracted in an alkaline medium from the washed organic phase. The uranium is, for example, reextracted with ammonium carbonate and ammonia to adjust the pH. This reextraction enables a quantity of uranium corresponding to approximately 95% to 100% of the total quantity contained in the initial organic solution to be solubilized in the ammonium carbonate.

The process of the invention which enables the iron to be separated from the uranium and the iron to be removed, limits the precipitation of iron in the ammonium carbonate medium.

In the process of the invention, the following practical details may also be specified.

In practice, in the process of the invention, the solvent passes through a loop.

In a first stage, the solvent is brought into contact with a starting phosphoric acid solution (uranium-containing phosphoric acid with contains iron) in order to extract the uranium.

A solvent thus charged with uranium, but which also contains iron, forms the initial organic solution defined above.

This initial organic solution is de-ironed in a second stage and the solvent thus de-ironed is subjected, in a third stage, to a washing and then subjected, in a fourth stage, to a reextraction, in order to reextract the uranium.

The solvent which is thus uranium-depleted is then subjected, in a fifth stage, to an acidification, because the reextraction stage mentioned above is generally carried out in an alkaline medium.

The acidification is generally carried out with phosphoric acid which is advantageously de-ironed or with sulfuric acid, which may originate from the effluents obtained at the end of the first stage of extraction.

However, it is not necessary to remove iron from the solvent thus acidified with the phosphoric acid containing iron, because when the acidified solvent is brought into contact with the starting phosphoric acid solution the iron balance is not altered.

One of the preferred variants of the process of the invention is shown diagrammatically in FIG. 1.

The influent (a), essentially containing phosphates and also containing uranium and iron, is treated, especially with sulfuric acid, to be converted into phosphoric acid (b). The phosphoric acid preparation stage is shown at (1).

The phosphoric acid containing uranium and iron is subjected to an extraction stage shown at (2), using one of the solvents (s) mentioned above, introduced counter-currently, to give on the one hand uranium-depleted effluents (d) containing iron and on the other hand the initial organic solution (e) which is formed from the solvent (s) loaded with uranium and also with iron.

The initial organic solution (e) containing uranium and iron is subjected to a de-ironing stage (3), using one of the acids (f) mentioned above, introduced counter-currently.

This de-ironing leads to a de-ironed organic solution, shown at (g), and to acid loaded with iron, shown at (t).

The de-ironed organic solution (g) containing uranium is then subjected to the washing stage shown at (4) using water (h) introduced counter-currently.

The de-ironed organic solution (g) containing uranium is shown at (i) at the end of the washing stage.

The organic solution (i) is subjected to a reextraction stage shown at (5), using ammonium carbonate and ammonia (j) introduced counter-currently. A uranium-rich ammonium carbonate eluate (k) on the one hand and the uranium-depleted solvent (m) leaving the reextraction stage, on the other, are obtained.

The solvent (m) is subjected to an acidification stage shown at (6), especially using phosphoric acid ($d_1$), introduced counter-currently and originating from the uranium-depleted effluents (d).

The solvent (s) thus acidified is used in the extraction stage (2).

The invention will be better understood with the following examples, which are given for illustration without implying limitation.

EXAMPLE 1: De-ironing using oxalic acid

This example relates to the process of the invention in which oxalic acid is used to extract the iron from an initial organic solution.

As there is no reaction taking place between uranium and oxalic acid, the uranium remains in the organic solution and the iron oxalate passes into aqueous solution.

This operation was carried out counter-currently and continuously over 5 stages, under the experimental conditions given below:

| | |
|---|---|
| $H_2C_2O_4.2H_2O$ concentration | 23 g/l |
| Number of stages | 5 |
| Organic/aqueous ratio (by volume) | 1:2.7 |
| Initial organic solution flow rate | 0.1 L/h |
| Oxalic acid solution flow rate | 0.27 L/h |
| Internal recycling of the aqueous phase | 0.126 L/h |
| Period of operation | 62 h |
| Average rate of removal | 80 to 85% of Fe |
| Oxalic acid consumption | 8 to 10 kg/kg of Fe |

The results obtained for the five stages with three initial organic solutions with different iron concentrations are as follows:

| | Example No. 1 Fe concentration in the solvent | Example No. 2 Fe concentration in the solvent | Example No. 3 Fe concentration in the solvent |
|---|---|---|---|
| 1st stage | 1353 mg/l | 1482 mg/l | 1275 mg/l |
| 2nd stage | 858 mg/l | 1073 mg/l | 965 mg/l |
| 3rd stage | 345 mg/l | 637 mg/l | 627 mg/l |
| 4th stage | 151 mg/l | 347 mg/l | 431 mg/l |
| 5th stage | 97 mg/l | 210 mg/l | 253 mg/l |

Uranium is not reextracted at all during this operation. Within the limits of experimental error, the uranium concentrations in the solvent are identical in all stages.

From a technical point of view, the extraction of iron with oxalic acid gives remarkable results and requires between approximately 8 and approximately 10 kg of oxalic acid to remove 1 kg of iron.

The oxalic acid may then be regenerated by converting the iron oxalate into calcium oxalate with lime and the latter into oxalic acid by reacting with sulfuric acid. The reactions are as follows:

$$Fe_2(C_2O_4)_3 + 3Ca(OH)_2 \rightarrow 2Fe(OH)_3 + 3CaC_2O_4 + 3\text{-}H_2O$$

$$CaC_2O_4 + H_2SO_4 \rightarrow CaSO_4 + H_2C_2O_4$$

Figure 2:
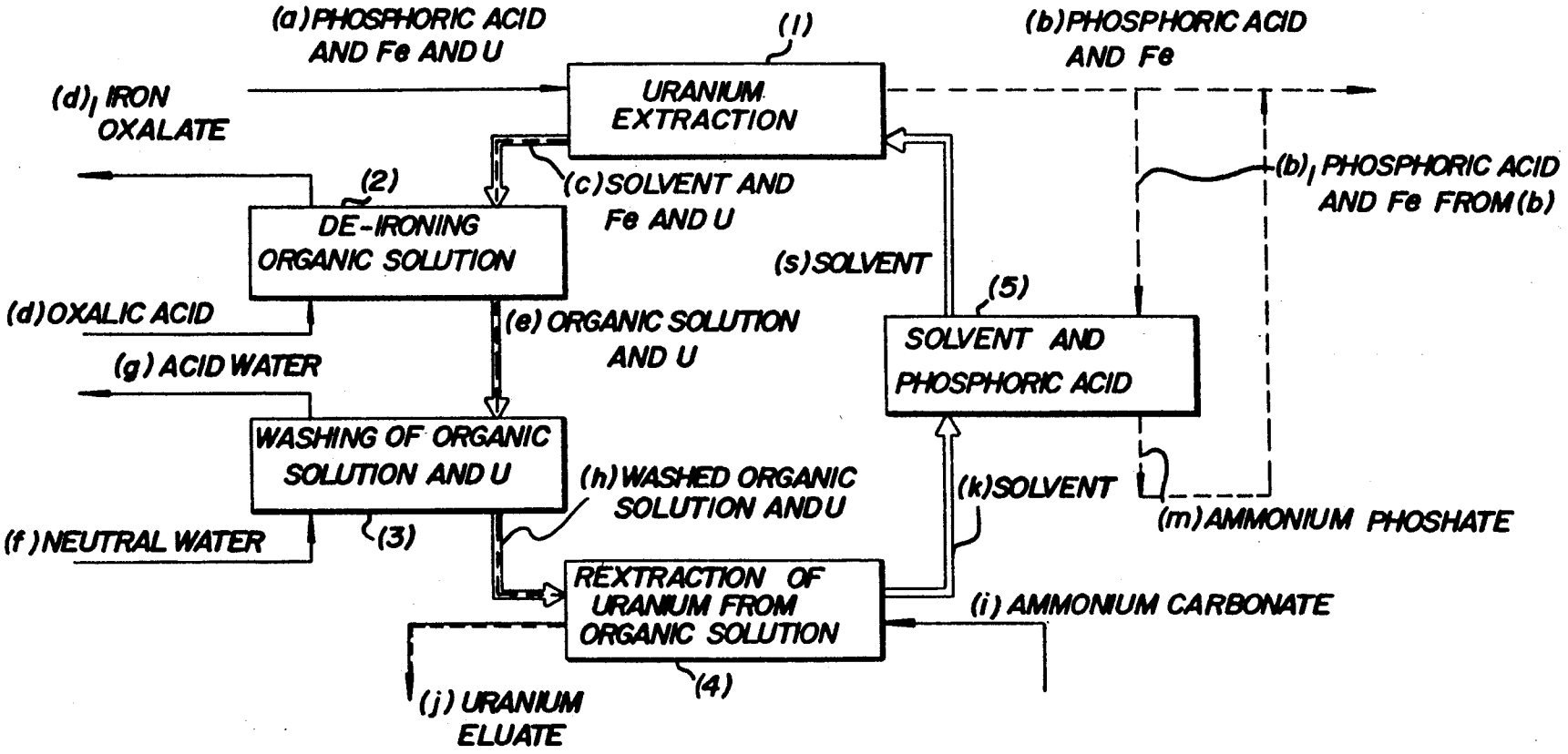
FIG. 2 is a block diagram of the use of oxalic acid for removing iron from an organic solution containing uranium in Example 1.

FIG. 2 is a diagram of the principle of the process of the invention, iron being removed with oxalic acid. The figures are given by way of indication for a plant which treats 80 $m^3/h$ of phosphoric acid.

At () is shown the stage of extraction of uranium from the influent (a) consisting of phosphoric acid (442 g/l of $H_3PO_4$), containing uranium (0.08 g/l) and iron (1.31 g/l), and the flowrate of which is 80 $m^3/h$.

This extraction is carried out using a solvent(s) introduced counter-currently.

After the extraction of uranium, a phosphoric acid effluent (b) which contains iron and which is free from uranium and the solvent containing uranium and iron (c), which was previously called initial organic solution, are obtained.

This initial organic solution (c) is subjected to a de-ironing stage shown at (2), using an oxalic acid solution (d) introduced counter-currently, at a flow rate of 3.5 $m^3/h$, to give, on the one hand, an iron oxalate ($d_1$) at a rate of 3.5 $m^3/h$ and, on the other hand, the de-ironed organic solution containing uranium (e).

The de-ironed organic solution containing uranium (e) is then washed at stage (3) using neutral water (f), at a flow rate of 1.5 $m^3/H$, which gives an acid water (g) at a rate of 1.5 $m^3/h$ and the de-ironed washed organic solution containing uranium (h).

The uranium is reextracted from the de-ironed organic solution (h) at the reextraction stage shown at (4), using an ammonium carbonate solution (i), introduced counter-currently at a flow rate of 0.6 $m^3/h$, which gives on the one hand a uranium-containing eluate (j), in which uranium is in the form of $UO_2(CO_3)_3(NH_4)_4$ and is present at the rate of approximately 10 g/l and on the other hand the uranium-depleted solvent (k).

The uranium-depleted solvent (k) is then acidified in stage (5) using phosphoric acid which is not de-ironed ($b_1$), introduced counter-currently at a flow rate of 1.5 $m^3/h$, originating from a part of phosphoric effluent (b).

At the end of stage (5), an ammonium phosphate solution (m), and the acidified solvent (s), at a rate of 4.9 $m^3/h$, which is reintegrated into the uranium extraction stage (1), are obtained.

EXAMPLE 2: Using a mixture of sulfuric acid and de-ironed phosphoric acid de-ironing the phosphoric acid This example relates to the preparation of advantageously uranium-depleted, de-ironed phosphoric acid which is used in the preparation of a sulfuric-phosphoric mixture.

The process of the invention in which sulfuric-phosphoric acid in which the phosphoric acid is de-ironed beforehand is used advantageously comprises the following stages:

a counter-current preparation of uranium-depleted phosphoric acid with "fresh" or regenerated solvent (free from iron and uranium), the mixing of the sulfuric acid and the de-ironed phosphoric acid and a counter-current removal of iron from the organic solvent using the sulfuric-phosphoric mixture in which the phosphoric acid was de-ironed.

The uranium-depleted phosphoric acid generally always contains large amounts of iron. A certain quantity of this acid free of iron may be prepared by carrying out a continuous operation over a suitable number of stages.

The de-ironing trials are carried out using two phosphoric acids: an undiluted uranium-depleted phosphoric acid effluent, the concentration of which is 4.62 M, and a uranium-depleted phosphoric acid effluent which is diluted with a part of the water washings to a final concentration of 3.4 M. The reaction kinetics are as follows:

(1) using the 4.62 M uranium-depleted phosphoric acid, the characteristics of which are as follows:

| | |
|---|---|
| U | <3 mg/l |
| Fe | 1290 mg/l |
| $P_2O_5$ | 328 g/l |

The period of contact with the corresponding percentage of iron extracted are as follows:

| Period of contact | % Fe extracted |
|---|---|
| 30 s | 29.0 |

-continued

| Period of contact | % Fe extracted |
|---|---|
| 1 mn | 30.9 |
| 2 mn | 35.7 |
| 5 mn | 38.6 |
| 10 mn | 40.4 |
| 15 mn | 39.0 |

The residual iron content of the acid is 48 mg/l; and (2) using the 3.4 M uranium-depleted phosphoric acid, the main characteristics of which are as follows:

| | |
|---|---|
| U | <3 mg/l |
| Fe | 950 mg/l |
| $P_2O_5$ | 242 g/l |

The period of contact with the corresponding percentage of iron extracted are as follows:

| Period of contact | % Fe extracted |
|---|---|
| 30 s | 49.7 |
| 1 mn | 53.2 |
| 2 mn | 57.6 |
| 5 mn | 62.5 |
| 10 mn | 80.6 |

The residual iron content of the acid is 10 mg/l.

Figure 3:
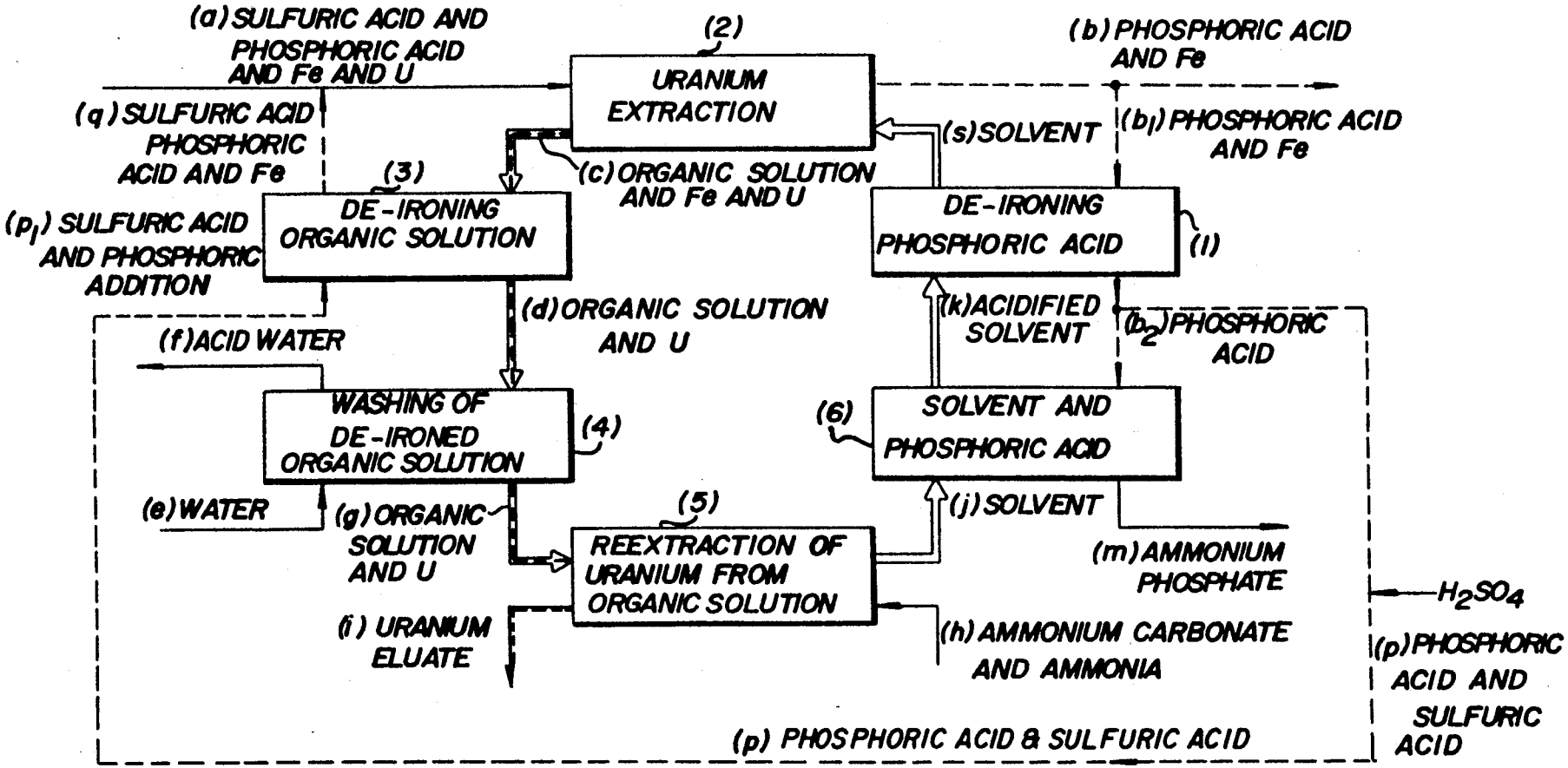
FIG. 3 and 4 are block diagrams of the use of a mixture of sulfuric acid and de-ironed phosphoric acid for removing iron from an organic solution containing uranium in Example 2.
Figure 4:
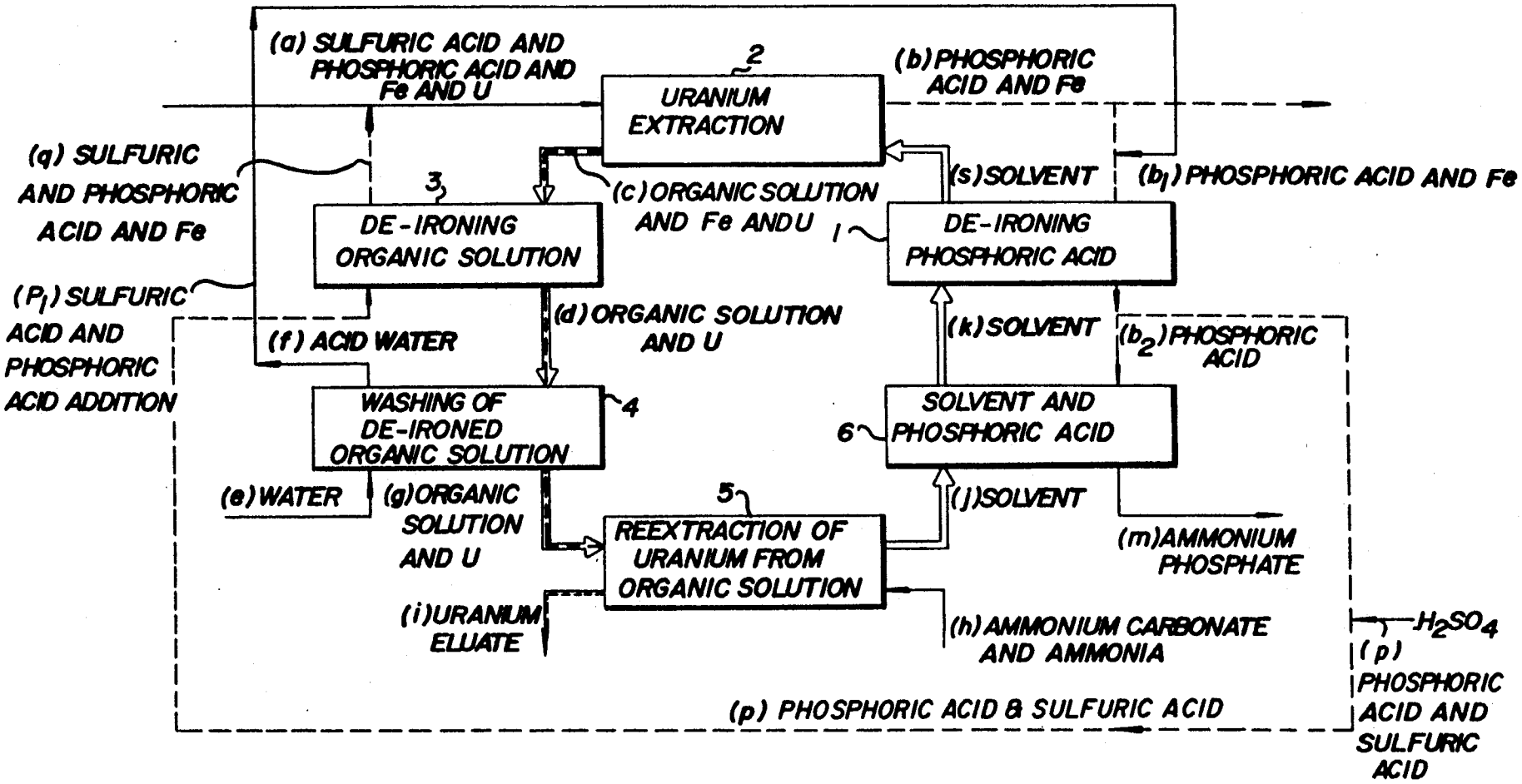

FIGS. 3 and 4 show diagrammatically the stages of the process of the invention, in order to carry out the de-ironing of an initial organic solution, using a sulfuric-phosphoric mixture in which the phosphoric acid is uranium-depleted and de-ironed respectively.

The influent consisting of the sulfuric-phosphoric mixture containing 1 290 mg/l of iron and uranium is shown at (a) on FIG. 3.

At (2) is shown the extraction of uranium using one of the solvents (s) mentioned above, introduced counter-currently, which leads:

on the one hand to the production of an effluent (b), consisting of uranium-depleted phosphoric acid, with a concentration of 4.62 M and containing 890 mg/l of iron, and on the other hand to an initial organic solution containing 2125 mg/l of iron and 1 375 mg/l of uranium.

The initial organic solution (c) is subjected to a de-ironing stage shown at (3) using the sulfuric-phosphoric mixture in which the phosphoric acid has previously been de-ironed, introduced counter-currently over 2 to 6 stages. This gives, on the one hand, the de-ironed organic solution (d) (containing approximately 300 mg/l of iron) containing uranium and on the other hand an effluent consisting of the sulfuric-phosphoric mixture loaded with iron (q), which is recycled into the influent defined above.

The de-ironed organic solution (d) containing uranium is subjected to a washing stage shown at (4), using water (e) introduced counter-currently, and acid water (f) on the one hand and the de-ironed and washed organic solution (g) containing uranium, on the other, are obtained.

The organic solution (g) is subjected to a uranium reextraction stage shown at (5), using ammonium carbonate and ammonia (h), introduced counter-currently. A uranium-containing eluate (i) on the one hand, and the uranium-depleted solvent (j) on the other, are obtained. The solvent (j) is then acidified, in an acidification stage, shown at (6), using de-ironed, uranium-depleted phosphoric acid ($b_2$) of concentration 4.62 M which is introduced counter-currently and which only contains 48 mg/l of iron. Phosphoric acid ($b_2$) is introduced counter-currently to obtain:

on the one hand the uranium-depleted, de-ironed and acidified solvent (k), and on the other hand ammonium phosphate (m).

At (1) is shown the stage of de-ironing the uranium-depleted phosphoric acid ($b_1$), using uranium-depleted and de-ironed solvent (k), introduced counter-currently.

The uranium-depleted phosphoric acid ($b_1$) is an aliquot of the uranium-depleted phosphoric acid (b), the phosphoric acid ($b_1$) representing approximately 10% by volume of the uranium-depleted phosphoric acid (b).

The de-ironing stage gives de-ironed phosphoric acid ($b_2$) of concentration 4.62 M and which contains 48 mg/l of iron to which sulfuric acid is added (the addition of sulfuric acid is shown at (p)), under conditions which give the appropriate composition and acidity of the sulfuric-phosphoric mixture.

This sulfuric-phosphoric mixture ($p_1$) is introduced into the initial organic solution de-ironing stage (3).

The de-ironing of the phosphoric acid ($b_1$) using the solvent (k) gives the solvent (s) which contains 297 mg/l of iron.

The quantity of iron in the solvent (s) relative to that of the solvent (k) is not significantly altered, considering that the solvent (k) is used for de-ironing a small quantity of phosphoric acid.

The influent consisting of the sulfuric-phosphoric mixture in which the phosphoric acid has previously been de-ironed, containing 1 290 mg/l of iron and uranium, is shown at (a) in FIG. 4.

At (2) is shown the extraction of uranium using one of the solvents (s) mentioned above, introduced counter-currently, which gives, on the one hand, an effluent (b), consisting of uranium-depleted 4.2 M phosphoric acid containing 1 190 mg/l of iron, and, on the other hand, an initial organic solution (c) containing 2 021 mg/l of iron and 1 313 mg/l of uranium.

The initial organic solution (c) is subjected to a de-ironing stage shown at (3), using the sulfuric-phosphoric mixture in which the phosphoric acid has previously been de-ironed, introduced counter-currently over five stages.

This gives, on the one hand, the de-ironed solvent (d) (containing approximately 300 mg/l of iron) containing uranium and an effluent consisting of the sulfuric-phosphoric mixture loaded with iron (q) which is reintroduced into the influent defined above.

The de-ironed solvent (d) containing uranium is subjected to a washing stage shown at (4), using water (e) introduced counter-currently, and this gives acid water (f) on the one hand and the de-ironed and washed solvent (g) containing uranium on the other.

The solvent (g) is subjected to a stage of reextraction of the uranium shown at (5) using ammonium carbonate and ammonia (h), introduced counter-currently. This gives a uranium-containing eluate (i) on the one hand and the uranium-depleted solvent (j) on the other. The solvent (j) is then acidified, in an acidification stage shown at (6), using uranium-depleted and de-ironed phosphoric acid ($b_2$) of a concentration of 3.4 M and containing 10 mg/l of iron, to obtain uranium-depleted, de-ironed solvent (k) and ammonium phosphate (m).

The stage of de-ironing the uranium-depleted phosphoric acid ($b_1$) using the uranium-depleted and de-ironed solvent (k) is shown at (1).

The uranium-depleted phosphoric acid ($b_1$) is an aliquot of the uranium-depleted phosphoric acid (b), the phosphoric acid ($b_1$) representing approximately 10% by volume of the phosphoric acid (b).

In order to obtain the phosphoric acid ($b_1$), a fraction of the phosphoric acid (b) defined above is taken and it is subjected to a dilution using the water of washing (f).

The de-ironed phosphoric acid ($b_2$) of concentration 3.4 M and containing 10 mg/l of iron is then mixed with sulfuric acid which is introduced at (p) and this sulfuric-phosphoric mixture ($p_1$) is introduced into the de-ironing stage (3) of the initial organic solution.

The de-ironing of the phosphoric acid ($b_1$) using the solvent (k) gives the solvent (s) containing 184 mg/l of iron.

The quantity of iron in the solvent (s) relative to that of the solvent (k) is not significantly altered considering that the solvent (k) is used to de-iron a small quantity of phosphoric acid.

EXAMPLE 3: De-ironing using a mixture of sulfuric acid and phosphoric acid

This embodiment of the process of the invention has the advantage that the sulfuric acid which is the complementary reagent for carrying out the de-ironing of the initial organic solution containing uranium and iron may be recycled for the treatment of phosphates and the weight of the latter in the reagent balance for the overall operation will be zero or almost zero.

It was observed that the addition of sulfuric acid to a uranium-depleted phosphoric acid enables the acid concentration to be increased and the use of evaporation for reconcentrating to be avoided, while lowering the minimum concentration required for the acid used.

It was also observed that there are optimum ratios between phosphoric acid and sulfuric acid which make it possible to limit the reextraction of uranium.

It was observed that there are sulfuric-phosphoric mixtures which take into account a number of industrial constraints, viz.

(1) the use of a sulfuric-phosphoric mixture of high concentration (400 to 550 g/l) (expressed as $H_2SO_4+H_3PO_4$), which can be used directly for the treatment of phosphates, (2) the achievement of a final acidity which is lower than that in the case of pure phosphoric acid (700 g/l);

(3) the restriction of uranium coextraction.

Extraction trials were carried out with the solvent, using 12 N sulfuric acid (by way of comparison) and two sulfuric-phosphoric mixtures, in which the phosphoric acid is de-ironed (containing less than approximately 50 mg/l of iron) and in which the normalities of sulfuric acid and phosphoric acid are 9 N and 3 N, and 3 N and 9 N respectively.

The results of these trials are collated in table III below.

| | Normality of $H_3PO_4$ and $H_2SO_4$ in the sulfuric-phosphoric mixture | | | | | |
|---|---|---|---|---|---|---|
| | $H_2SO_4$ $H_3PO_4$ | 12N — | $H_2SO_4$ $H_3PO_4$ | 9N 3N | $H_2SO_4$ $H_3PO_4$ | 3N 9N |
| | % U | % Fe | % U | % Fe | % U | % Fe |
| 1st stage | 0.07 | 13 | 0.7 | 45.5 | 1.2 | 62.8 |

-continued

| | Normality of $H_3PO_4$ and $H_2SO_4$ in the sulfuric-phosphoric mixture | | | | | |
|---|---|---|---|---|---|---|
| | $H_2SO_4$ $H_3PO_4$ % U | 12N — % Fe | $H_2SO_4$ $H_3PO_4$ % U | 9N 3N % Fe | $H_2SO_4$ $H_3PO_4$ % U | 3N 9N % Fe |
| 2nd stage | 0.12 | 19.5 | 1.35 | 65.5 | 2.2 | 74.5 |
| 3rd stage | 0.20 | 24.2 | 2 | 76.5 | 3.3 | 82.8 |

% U: percentage of U extracted from the solvent
% Fe: percentage of Fe extracted from the solvent The results of these trials show the efficiency of the sulfuric-phosphoric mixtures in the reextraction of iron from the organic solution. It is also noticed that the quantity of uranium coextracted is only low, or even very low, which is the result sought.

Figure 5:
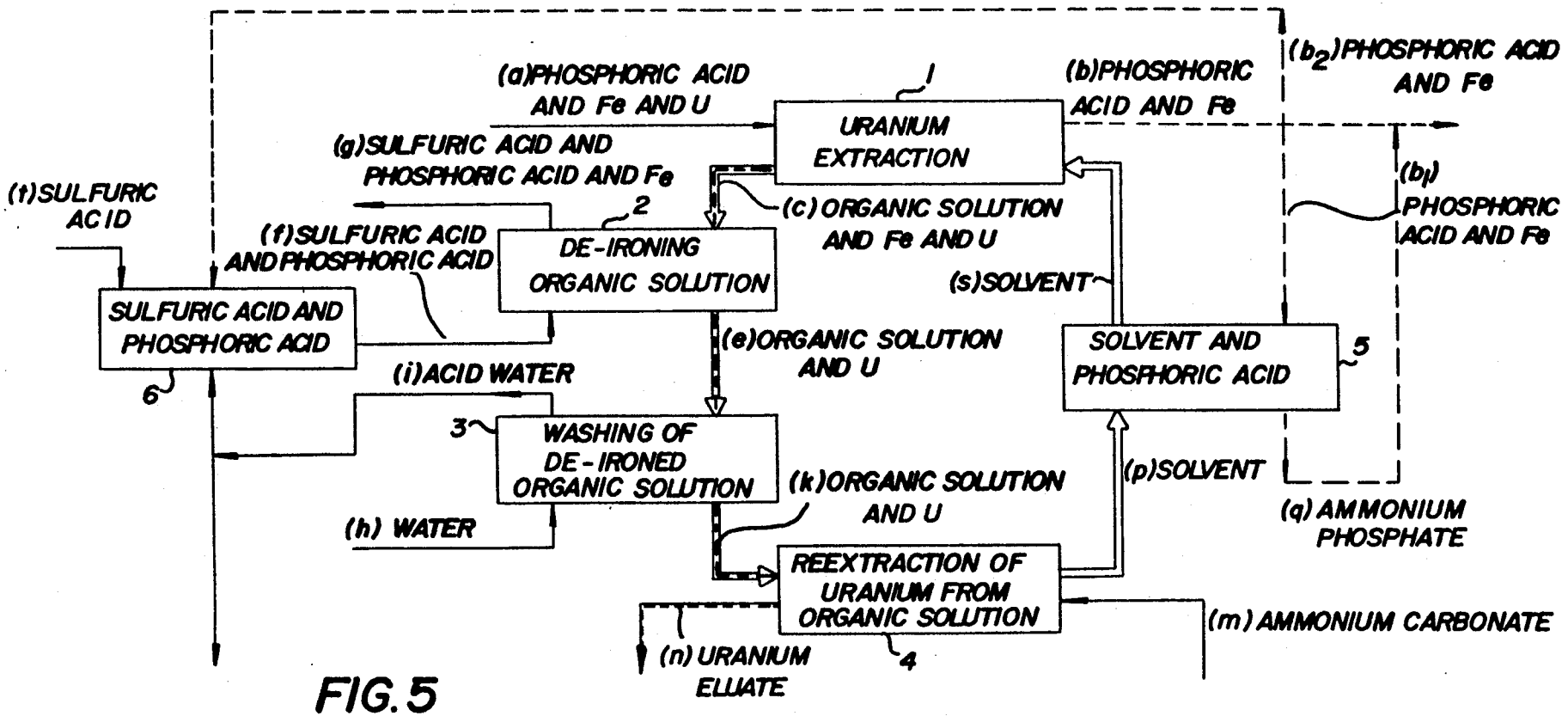
FIG. 5 is a block diagram of the use of a mixture of phosphoric acid and sulfuric acid for removing iron from an organic solution containing uranium in Example 3.

The process of the invention in which the sulfuric-phosphoric mixture is used is shown in FIG. 5.

The influent consisting of phosphoric acid (442 g/l) containing 0.08 g/l of uranium and 1.31 g/l of iron and the flow rate of which is 80 $m^3/h$ is shown at (a) in FIG. 5.

The extraction of uranium is carried out at the stage shown at (1), using one of the organic solvents mentioned above (s), introduced counter-currently to give, on the one hand, effluents (b) consisting of uranium-depleted phosphoric acid and, on the other hand, an initial organic solution containing uranium and iron (c).

The initial organic solution (c) is then de-ironed in stage (2), using a mixture of sulfuric acid and phosphoric acid introduced counter-currently at a rate of 4.9 $m^3/h$ (f), to give, on the one hand, a de-ironed organic solution (e) containing uranium and on the other hand a de-ironing effluent (g) consisting of the sulfuric-phosphoric mixture loaded with iron, which is redirected towards phosphate treatment, thus enabling the sulfuric acid to be reused.

The de-ironed organic solution (e) is then washed, in stage (3), using water (h), introduced counter-currently at a flow rate of 1.24 $m^3/h$, to give the acid water (i) at a rate of 1.24 $m^3/h$ and a uranium-containing washed organic solution (k).

The solution (k) is then subjected to a uranium reextraction stage shown at (4), using ammonium carbonate (m), introduced counter-currently at a flow rate of 0.6 $m^3/h$, to give, on the one hand, a uranium-containing eluate (n) and on the other hand an alkaline uranium-depleted and de-ironed solvent (p).

The solvent (p) is then acidified in stage (5) using phosphoric acid which is not de-ironed ($b_1$), introduced counter-currently, to give an ammonium phosphate solution (q) and the acid solvent (s) at a rate of 4.5 $m^3/h$.

The phosphoric acid which is not de-ironed ($b_1$) originates from the phosphoric acid effluent (b). Another part ($b_2$) of the phosphoric acid effluent (b), the flow rate of which is 3 259 $m^3/h$, is used to prepare the sulfuric-phosphoric acid mixture, the sulfuric acid (t) being added at a rate of 0.4 $m^3/h$.

The preparation of the abovementioned sulfuric-phosphoric acid mixture of normality 12 N is shown at stage (6).

We claim:

1. A process for selectively removing iron having a valence of 3, from an organic solution which contains uranium having a valence of 6, which initially contains at least 1 g/l of iron and which comprises:

a neutral phosphine oxide of the formula:

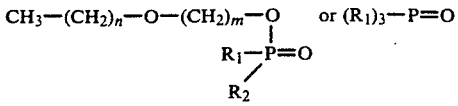

in which: $R_1$ and $R_2$, which may be identical or different, are each a straight-chain or branched alkyl of 4 to 10 carbon atoms, m is an integral of 1 to 3, and n is an integer of 4 to 10; and an acid organophosphorous compound of the formula:

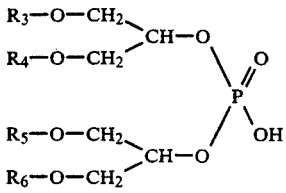

in which: $R_3$, $R_4$, $R_5$ and $R_6$, which may be identical or different, are each a straight-chain or branched alkyl of at least 4 carbon atoms or an aryl of 6 to 10 carbon atoms;

said process comprising the step of:

contacting said organic solution with an aqueous acid chosen from the group consisting of: oxalic acid and a mixture of phosphoric acid and sulfuric acid; wherein iron in said organic solution passes into said aqueous acid.

2. The process of claim 1, wherein $R_3$, $R_4$, $R_5$ and $R_6$ comprise an alkyl of up to 10 carbon atoms or an aryl.

3. The process of claim 2, wherein $R_1$ and $R_2$ comprise an alkyl of 6 carbons atoms, m is 1, n is 7, and $R_3$, $R_4$, $R_5$, and $R_6$ comprise an alkyl of up to 6 carbon atoms or an aryl.

4. The process of claim 3, wherein the iron in said organic solution comprises iron in the form of a salt of said organophosphorous compound and the uranium in said organic solution is in the form of a salt of said organophosphorous compound.

5. The process of claim 1, wherein said organic solution initially contains approximately 0.3 to 3 g/l of uranium and approximately 1 to 4 g/l of iron.

6. The process of claim 5 wherein said organic solution initially contains approximately 0.4 to 1.4 g/l of uranium and approximately 1.2 g/l of iron.

7. The process of claim 1, wherein said phosphine oxide comprises trioctylphosphine oxide or di-n-hexyl-octoxymethylphosphine oxide, and said organophosphorous compound comprises bis-1,3-dibutoxy-2-propylphosphoric acid or bis-1,3-dihexyloxy-2-propylphosphoric acid.

8. The process of claim 7, wherein said organic solution is contacted with a starting phosphoric acid solution which contains approximately 50 to 300 mg/l of uranium and approximately 1 to 15 g/l of iron before said organic solution is contacted with said aqueous acid.

9. The process of claim 8, wherein said starting phosphoric acid solution comprises a gravimetric ratio of U/Fe of approximately 1:10 3:1000; wherein as a result of said organic solution contacting said starting phosphoric acid solution, at least approximately 95% of the uranium in said starting phosphoric acid solution is transferred to said organic solution, said organic solution contains at least 1 g/l of iron, a gravimetric ratio of Fe/U of at least approximately 0.8 and said starting phosphoric acid solution contains approximately 80% to 90% of the iron which it contained before contacting said organic solution; and wherein as a result of said aqueous acid contacting said organic solution, approximately 50% to 90% of the iron in said organic solution is transferred to said aqueous acid and said organic solution contains at least approximately 85% of the uranium which it contained before contacting said aqueous acid.

10. The process of claim 9, wherein the gravimetric ratio of Fe/U in said organic solution after contacting said starting phosphoric acid solution and before contacting said aqueous acid is approximately 1:1 to 2.5:1.

11. The process of claim 9, wherein as a result of said organic solution contacting said aqueous acid, approximately 70% of the iron contained in said organic solution is transferred to said aqueous acid.

12. The process of claim 9, wherein said organic solution is subsequently washed until its $PO_4$ concentration is no more than approximately 1 g/l; and then, the uranium in said organic solution is reextracted with an alkaline medium.

13. The process of claim 12, wherein said organic solution is washed with water; and wherein said alkaline medium comprises an ammonium carbonate medium.

14. The process of claim 1, wherein said aqueous acid comprises oxalic acid which is used at a rate of approximately 8 to 10 kg per kg of iron.

15. The process of claim 14, wherein said aqueous oxalic acid is subsequently regenerated.

16. The process of claim 15, wherein said aqueous oxalic acid is regenerated by treating it with approximately 1 to 4 kg of calcium hydroxide per kg of oxalic acid and then with 2 to 8 kg of sulfuric acid.

17. The process of claim 1, wherein said aqueous acid comprises 3 N to 12 N phosphoric acid and 3 N to 12 N sulfuric acid.

18. The process of claim 17, wherein said aqueous acid comprises 3 N sulfuric acid and 9 N phosphoric acid and contains no more than approximately 1.5 g/l of iron.

19. The process of claim 17, wherein said aqueous acid comprises 9 N sulfuric acid and 3 N phosphoric acid from which iron has been removed and contains approximately 50 to 600 mg/l of iron.

20. The process of claim 17, wherein said aqueous acid comprises phosphoric acid, from which uranium has been extracted and which contains less than approximately 10 mg/l of uranium.

* * * * *